United States Patent [19]

Tschinkel et al.

[11] 4,027,587

[45] June 7, 1977

[54] PULLEY CONSTRUCTION FOR HIGH SPEED PRINTER BELT

[75] Inventors: John Tschinkel, Great Neck; Raymond A. Ballweg, Smithtown, both of N.Y.

[73] Assignee: Potter Instrument Company, Inc., Plainview, N.Y.

[22] Filed: Sept. 8, 1975

[21] Appl. No.: 611,020

[52] U.S. Cl. ..... 101/111; 74/229; 101/93.14

[51] Int. Cl.[2] ..... B41J 1/20

[58] Field of Search ..... 101/111, 93.14, 93.13; 74/243 R, 229, 230.01, 230.05

[56] References Cited

UNITED STATES PATENTS

| | | | |
|---|---|---|---|
| 3,379,125 | 4/1968 | Antonucci | 101/111 X |
| 3,491,806 | 1/1970 | Kaisser et al. | 74/229 X |
| 3,557,693 | 1/1971 | Kuchenbecker et al. | 101/93.14 |
| 3,587,455 | 6/1971 | Childress et al. | 101/111 X |
| 3,621,778 | 11/1971 | Ripple et al. | 101/111 X |
| 3,633,501 | 1/1972 | Edward | 101/111 |
| 3,638,565 | 2/1972 | Dreiza et al. | 101/111 |
| 3,949,665 | 4/1976 | Perry | 101/111 |

*Primary Examiner*—Edward M. Coven
*Attorney, Agent, or Firm*—Alfred W. Barber

[57] ABSTRACT

Chain or belt printers for high speed print-out from computers and the like employ metal or plastic type slugs clipped to a toothed elastomeric timing belt. The belt passes around two toothed pulleys one of which drives the belt so that the type slugs pass along a printing line at a predetermined speed. Pins holding and locating the slugs on the belt extend inside both top and bottom edges of the belt.The pulleys are constructed with peripheral slots to mate with the teeth on the inner surface of the timing belt and added teeth to support the belt at both of its outer edges and between the pins holding the slugs to the belt. This added support for the belt improves the printing accuracy under dynamic high speed printing operations.

1 Claim, 6 Drawing Figures

PULLEY CONSTRUCTION FOR HIGH SPEED PRINTER BELT

BACKGROUND AND SUMMARY OF THE INVENTION

High speed chain or belt printers for computer print-out and the like often employ type slugs attached to an elastomeric timing belt wherein the teeth of the timing belt provide accurate locating means for the type slugs. A high speed printer in accordance with this concept is shown and described in U.S. Pat. No. 3,621,778. In this patent an elastomeric timing belt having accurately spaced teeth along its inner surface carries a plurality of type slugs clipped over the upper and lower edges of the belt and secured and accurately located each by two pins top and bottom each two pins gripping a tooth of the belt. The belt passes over two pulleys one of which is a drive pulley and the other an idler pulley for maintaining the belt under longitudinal tension. The pulleys carry peripheral slots shaped and spaced to accurately mate with the ribs of the belt. The area between the slots which could be considered to be the pulley teeth ride against the belt between the teeth.

Now the pins which secure the slugs on the belt overlap the inside of the belt top and bottom and provision must be made so that these pins do not ride on or come in contact with the surface of the pulleys. In the past this has been accomplished by limiting the width of the pulley slots and ribs to the inside distance between the slug holding pins as can be seen in FIG. 1 of U.S. Pat. No. 3,621,778 referenced above. This construction, however, leaves the edges of the belt for a distance equal to the slug mounting pin overlap unsupported as the belt goes around the pulleys. This lack of support along the edges of the belt and in the area of the slug mounting pins has been found to cause distortion of the edges of the belt and displacement of the slugs mounted along these edges. It will be appreciated that dynamically the belt is moved very fast along the print line and the slugs are subjected to rapid impact by the printing hammers. This high speed impact causes tension waves along the edges of the belt and with insufficient support in the area of the pulleys permits lateral motion and misalignment of the characters printed from the slugs.

In accordance with the present invention an additional set of ribs is provided at the top and bottom of the pulleys designed and positioned to provide support to the belt along the previously unsupported top and bottom edges. The ribs on these auxiliary pulleys have radii equal to the radii of the teeth of the main pulley, are equal in number to the ribs of main pulleys; and are positioned to fall between the pins of adjacent slugs. The slots between the teeth of these auxiliary pulleys are wide enough to clear the two mounting pins of each slug and including the teeth of the belt embraced by each set of two pins.

Figure 4A:
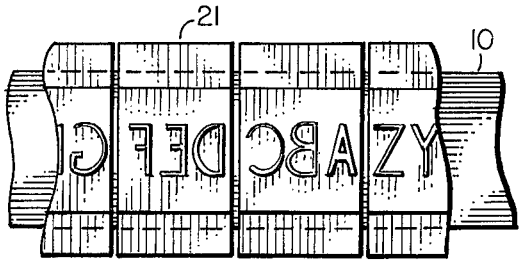

FIG. 4*a* is a front view of several three characters per slug character slugs.

Figure 4B:
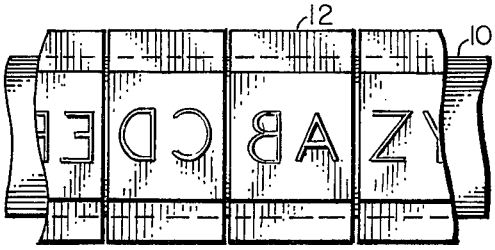

FIG. 4*b* is a front view of several two characters per slug character slugs.

Figure 5:
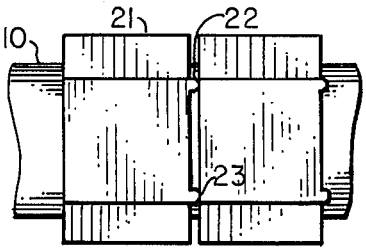

FIG. 5 is a detail of one type of character slug which may be used in conjunction with the apparatus of the present invention.

Figure 1:
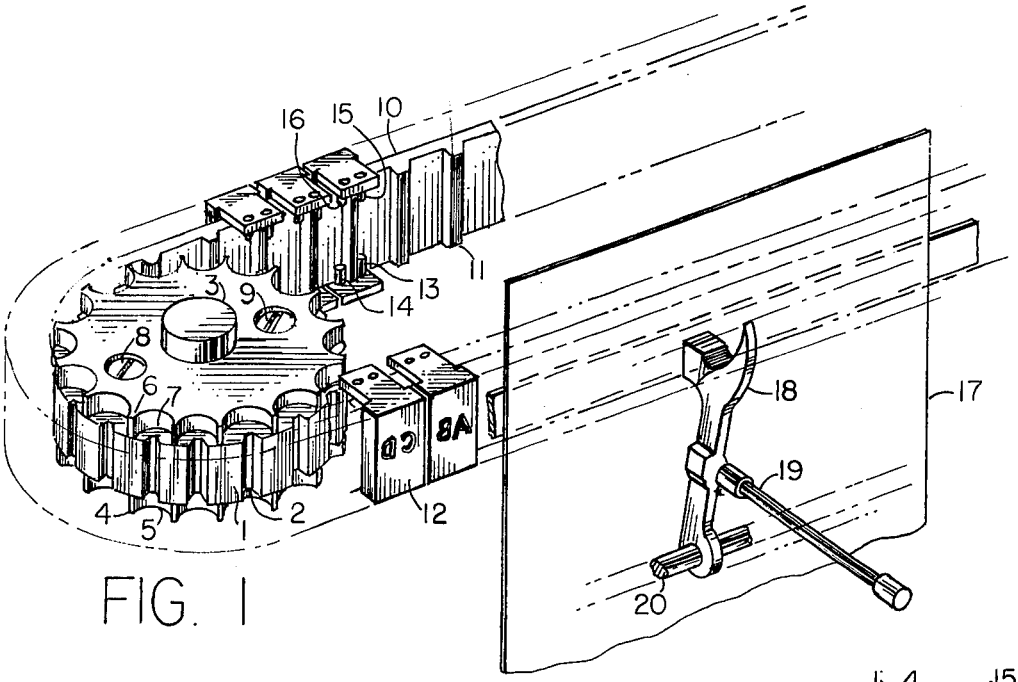
FIG. 1 is a cut-away perspective view of a pulley in accordance with the present invention showing it in relationship to the printing character carrying belt and a typical printing hammer.

FIG. 1 shows a toothed pulley comprising ribs 1 alternating with slots 2. Printing character belt 10 carries on its inner surface a plurality of equally spaced teeth 11. These teeth provide two functions; first, they mesh with slots 2 of the pulley to provide accurate drive of the belt and; second, they provide means for accurately locating character slugs 12 which are secured by pins 13, 14, 15 and 16, two along the lower edge of the belt and each pair embracing a belt tooth to accurately locate each character slug along the belt. The primary pulley carrying ribs 1 and slots 2 has a width no greater than the inner distance between the ends of the pins 13-16 so that these pins do not contact the pulley as the slugs pass around it.

The invention is illustrated by the additional ribbed pulleys carried on each side of the main pulley and having ribs 4 and slots 5 on the lower pulley and ribs 6 and slots 7 on the upper pulley. The two additional pulleys are clamped to the main pulley by screws 8 and 9 and the three assembled pulleys are mounted on shaft 3 which may be a drive shaft driven by suitable means, not shown. The character slugs are carried by the belt across a print-out medium such as sheet 17 and are impressed thereon by a plurality of hammers one of which is shown as hammer 18 pivoted at 20 and actuated by a rod 19 by suitable means, not shown.

It will be seen that the ribs of the added upper and lower pulleys extend to the same diameter as the ribs of the main pulley and hence will support the character belt out to its very edges at points between the character slugs while the slots in the added pulleys are designed to clear both the teeth 11 of the belt plus the locating pins 14–16, of the slugs. Thus, the belt is effectively supported out to both its upper and lower edges and any stretching or other undesired response to dynamic stresses is eliminated or at least substantially reduced.

Figure 2:
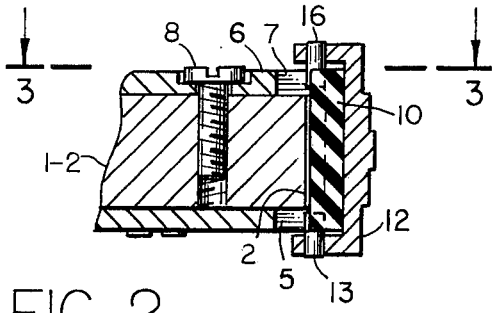
FIG. 2 is a cross-sectional detail showing the relationship of a typical character slug with the pulley.

FIG. 2, which is a cross-section of a portion of the three pulleys and belt and a character slug shows how the belt 10 is supported by the ribs of the upper and lower pulleys; how the belt teeth fit into the slots of the main pulley and how the belt teeth and slug pins 13 and 16 are accommodated by slots 5 and 7 of the two added pulleys.

Figure 3:
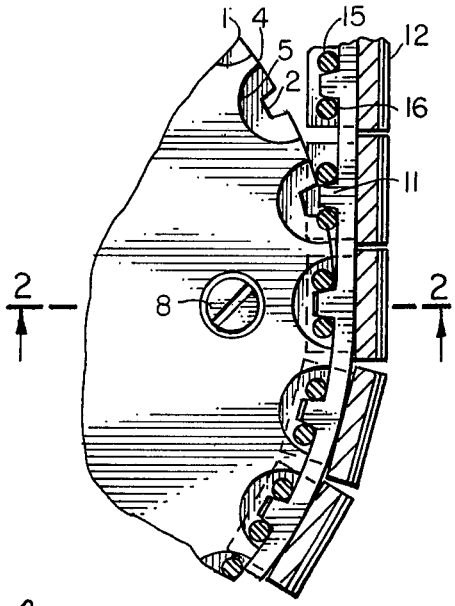
FIG. 3 is a top view of a portion of the pulley and a corresponding portion of the character slugs and belt.

FIG. 3 is a top view of a portion of the pulley assembly and the belt and slug combination again showing how ribs 4 support the edges of belt 10 at points between each belt tooth and slug mounting; how belt teeth 11 mesh with slots 2 in the main pulley and how slots 5 in the added pulley accommodate the belt teeth 11 and the slug mounting pins 15 and 16.

FIGS. 4*a* and 4*b* show three character slugs 21 and two character slugs 12 respectively carried by belt 10.

FIG. 5 shows character slugs 21 mounted on belt 10 and being provided with projections 22 and 23. The total slug width including projections 22 and 23 is substantially equal to the mean character spacing along the belt which in turn is equal to the spacing of teeth 11 along the belt. The purpose of these teeth is to maintain the slug spacing while showing openings between teeth for lint or other accumulations to collect or discharge without causing blockage between slugs which would increase their apparent widths and upset the dynamic chain reaction during printing operations.

While the three pulleys have been shown and described as three separate pulleys clamped together, it will be apparent that other methods of manufacture such as machining from a solid block or die casting can be employed without departing from the spirit and scope of the invention as set forth, in particular in the appended claims.

I claim:

1. In a high speed chain printer, the combination of;

an elastomeric endless timing belt having an elongated rectangular cross-section, a smooth outer surface and carrying teeth extending from top to bottom across the width of the belt and equally spaced along its inner surface;

a plurality of character bearing printing slugs attached along the outer surface of said belt and held in place by a pair of pins at the top and bottom of said slug and embracing the top and bottom of one of said teeth while leaving a clear center portion of said teeth;

a pulley for driving said belt along a predetermined path, said pulley including equally spaced peripheral slots matching said clear center portions of said teeth upper and lower clearances for said pins and including ribs between said slots and clearances equal in height to the width of said belt for supporting said belt to its full width in the area between said teeth.

* * * * *